US008242906B2

(12) United States Patent
Fawcett

(10) Patent No.: US 8,242,906 B2
(45) Date of Patent: Aug. 14, 2012

(54) MERCHANDISE DISPLAY STAND DEFINING AN ANGLED EXIT PATH

(75) Inventor: Christopher J. Fawcett, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 503 days.

(21) Appl. No.: 12/576,538

(22) Filed: Oct. 9, 2009

(65) Prior Publication Data

US 2011/0084838 A1 Apr. 14, 2011

(51) Int. Cl.
*G08B 13/12* (2006.01)

(52) U.S. Cl. ..... 340/568.2; 340/568.8; 340/687; 340/693.9

(58) Field of Classification Search .... 340/568.2–568.4, 340/568.8, 693.5, 693.9, 686.1, 687
See application file for complete search history.

(56) References Cited

U.S. PATENT DOCUMENTS

| | | | | |
|---|---|---|---|---|
| 2002/0011547 | A1 | 1/2002 | Gross et al. | |
| 2008/0142665 | A1 | 6/2008 | Belden et al. | |
| 2008/0169923 | A1* | 7/2008 | Belden et al. | 340/568.3 |
| 2009/0033492 | A1 | 2/2009 | Rapp et al. | |
| 2009/0173868 | A1 | 7/2009 | Fawcett et al. | |

FOREIGN PATENT DOCUMENTS

| | | | |
|---|---|---|---|
| WO | W02005/027694 | A2 | 3/2005 |
| WO | W02006/018464 | A1 | 2/2006 |

* cited by examiner

*Primary Examiner* — Thomas Mullen
(74) *Attorney, Agent, or Firm* — Christopher C. Dremann, P.C.

(57) ABSTRACT

A merchandise display stand for displaying an item of merchandise defines an angled exit path for a security cable attached to the merchandise. The display stand includes a base configured for attachment to a support surface and an upright extending from the base. The security cable extends from the base through an internal passageway defined by the upright to the merchandise. The upright has an arcuate or an angled shape relative to the support surface and the angled exit path forms an acute angle with a central axis between about fifteen and about seventy-five degrees. A sensor housing may be disposed between an upper end of the security cable and the merchandise and configured for attachment to the merchandise. A first displacement sensor may be provided for indicating whether the base is separated from the support surface and a second displacement sensor may be provided for indicating whether the merchandise is separated from the sensor housing. Electronic circuitry may also be provided for monitoring and detecting an unsecured state of the first and second displacement sensors and for activating an alarm when the first or second displacement sensor is in the unsecured state.

14 Claims, 4 Drawing Sheets

MERCHANDISE DISPLAY STAND DEFINING AN ANGLED EXIT PATH

FIELD OF THE INVENTION

The present invention relates generally to a merchandise display stand for displaying an item of merchandise. More particularly, the invention is a merchandise display stand defining an angled exit path for a security cable attached to the item of merchandise.

BACKGROUND AND RELATED ART

Merchandise display stands are utilized extensively to display items of merchandise in a retail store environment. Typically, a merchandise display stand is positioned on a support surface, such as a countertop, in a location that is convenient for a potential purchaser to examine, and in some instances operate, the merchandise. The display stand is secured to the support surface, and the merchandise is secured to the display stand to prevent theft of the merchandise. In some instances, the merchandise may be secured to a splitter box, a central alarm unit and/or a power supply so that multiple display stands share a single alarm and/or power source. The merchandise may be secured to the display stand mechanically, for example by a braided wire cable. Alternatively, or in addition, the merchandise may be secured to the display stand electrically, for example by an electrical cable defining a conductive path between the merchandise and the display stand. Typically, the electrical cable extends between a sensor operatively coupled to the merchandise and a monitoring circuit disposed within the display stand for determining the "state" of the sensor. In a common example, the merchandise is mounted on a sensor that includes a proximity switch or the like for indicating whether the merchandise is attached to the sensor. In a "secured" state, the merchandise is attached to the sensor, while the merchandise is separated from the sensor in an "unsecured" state. An audible or visual alarm is activated to alert store personnel when the monitoring circuit determines that the state of the sensor has changed from the secured state to the unsecured state.

Known merchandise display stands include a base for housing the monitoring circuit and an upright extending upwardly from the base for supporting the displayed merchandise at a desired height above the support surface. Depending on the type or size of the merchandise, the length of the upright may be varied to accommodate different items of merchandise. In most instances, the length of the upright varies between about three and about twelve inches. The upright may also serve as a collection tube for the mechanical and/or electrical security cable extending between the base of the display stand and the merchandise. In a particular example, the cable is a coiled helical cable containing one or more electrical conductors that extends in length under tension. Typically, the tensioned length of the helical cable is at least twice the un-tensioned length of the helical cable. In this manner, a potential purchaser may remove the merchandise and sensor from its display position on the upright of the display stand to more closely examine and/or operate the merchandise at a comfortable location, while the merchandise remains secured to the display stand. In the event that the merchandise is separated from the sensor or the conductive path between the merchandise and the display stand is interrupted, the monitoring circuit activates the alarm to alert store personnel of a possible theft of the merchandise. As the merchandise and sensor are returned to the display stand, the helical cable automatically retracts from its tensioned length to its un-tensioned length and is collected within the upright and the base of the display stand.

The upright, or collection tube, of existing merchandise display stands extends upwardly from the base in a vertical direction relative to the plane of the support surface. However, directly above the display stand is rarely, if ever, a comfortable location from which the potential purchaser can examine and/or operate the merchandise. Accordingly, the potential purchaser must first lift the merchandise upward (i.e. generally vertical) from the display stand and then pull the merchandise in a generally horizontal direction to position the merchandise at the comfortable location for examining and/or operating the merchandise. Alternatively, the potential purchaser may pull the merchandise to a comfortable location along an angled exit path from the upright of the display stand. As used herein, the term "angled exit path" refers to a path of travel of the merchandise that is neither parallel to the support surface (i.e. horizontal) nor perpendicular to the support surface (i.e. vertical). The angled exit path extends from the location of the merchandise in the display position on the display stand to the location of the position from which the potential purchaser desires to examine and/or operate the merchandise. The actual path of travel need not be linear, and instead, may be arcuate. However, the angled exit path is determined by a line extending between the display position and the desired position described above. As will be readily apparent, the angled exit path varies depending on the type and size of the merchandise, the vertical length of the upright, the tensioned length of the helical cable, and the height of the support surface relative to the height of the potential purchaser. Typically, however, the angled exit path defines an angle relative to a vertical axis of the upright between about fifteen degrees and about seventy-five degrees.

The angled exit path of conventional merchandise display stands having an upright that extends upwardly in a vertical direction from the base results in a number of disadvantages. For example, the force required to pull a mechanical and/or electrical cable from the upright along the angled exit path causes an angular (i.e. moment) force to be applied at the base of the display stand. As a result, the display stand may become detached from the support surface if the pulling force is exceptional or the display stand is not strongly secured to the support surface. Regardless, the angled exit path increases the amount of resistance between the upright and the security cable, thereby increasing the amount of force required to pull the cable from the display stand. In some instances, the increased amount of resistance may fray or otherwise damage (e.g. kink) the security cable. A frayed or otherwise damaged security cable might compromise the merchandise, and therefore, would require repair or replacement. In the case of a helical cable, the coils of the cable have a tendency to "hang up" or "snag" on the upright during extraction or retraction and thereby cause the item of merchandise to not reach the desired position, or to not return to the display position on the display stand. In addition, the merchandise display tends to be less aesthetically pleasing as the angle of the angled exit path increases in response to an increased vertical length of the upright.

Accordingly, there exists a need for a merchandise display stand defining an angled exit path for a security cable attached to an item of merchandise. There exists a particular need for a merchandise display stand defining an angled exit path for extracting a security cable such that a reduced force is sufficient to pull the security cable from an upright of the display stand along the angled exit path. There exists a specific need for a merchandise display stand defining an angled exit path for a security cable that reduces the amount of resistance between the cable and an upright of the display stand. There exists another specific need for a merchandise display stand defining an angled exit path for extracting a coiled helical cable that reduces or eliminates the tendency of the coils of the cable to "hang up" or "snag" on an upright of the display stand.

DETAILED DESCRIPTION OF PREFERRED EMBODIMENTS OF THE INVENTION

The accompany drawing figures illustrate one or more preferred embodiments of a merchandise display stand, indicated generally at 10, for displaying an item of merchandise, indicated generally at 30. By way of example, the merchandise 30 is a conventional cellular (e.g. mobile) telephone. However, the item of merchandise 30 may be any item of the type commonly placed on display for a potential purchaser to examine, and in some instances, operate, such as a digital camera, personal data assistant (PDA), global positioning system (GPS) navigation device, or the like. The display stand 10 is positioned on a support surface 11, for example a shelf, counter, desktop or the like, and is typically secured to the support surface by a mechanical fastener or a pressure sensitive adhesive (PSA), such as double-sided adhesive tape (not shown).

Figure 1:
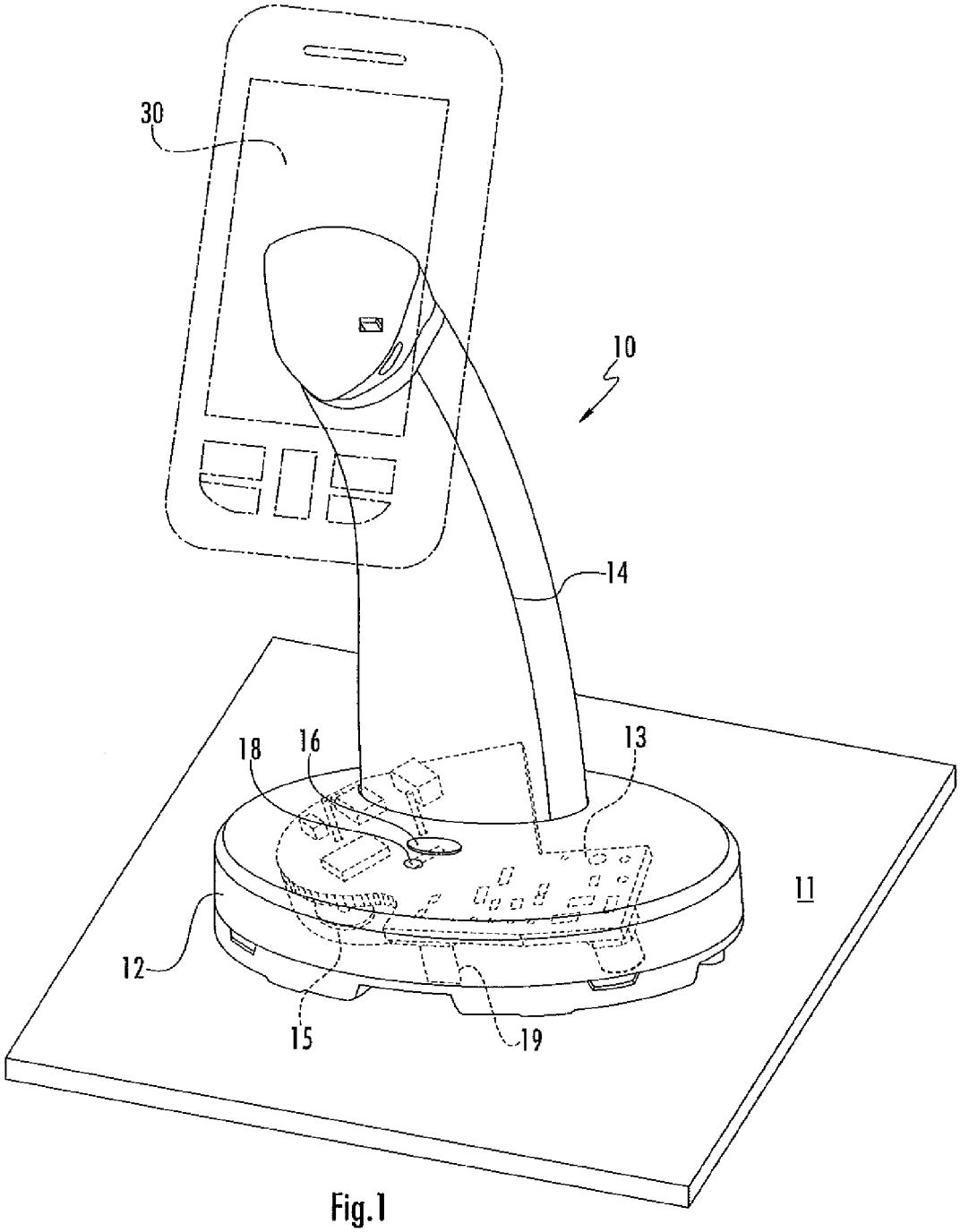
FIG. 1 is a right front perspective view of a merchandise display stand defining an angled exit path in accordance with the invention showing an item of merchandise in a display position on the display stand.

As shown in FIG. 1, the display stand 10 comprises a base 12 and an upright 14 extending upwardly from the base in a generally vertical direction. The upright 14 may have any suitable length so as to define a desired vertical height of the merchandise 30 relative to the support surface 11. Furthermore, the upright 14 of the exemplary embodiments shown and described herein defines an arcuate shape. Accordingly, the height of the distal end 15 of the upright 14 relative to the support surface 11 is a function of the length and the curvature of the of the upright. In certain embodiments, the length of the upright 14 may be fairly great and the curvature fairly slight, resulting in the distal end 15 being disposed at a height significantly above the support surface 11. In other embodiments, the length of the upright 14 may be fairly small and the curvature fairly severe, resulting in the distal end 15 being disposed at a height only slightly above the support surface 11. Typically, the length of the upright is such that the vertical height of the distal end 15 of the upright 14 relative to the support surface 11 varies between about three inches and about ten inches. However, it will be readily apparent to those skilled in the art that the broad concept of the invention is applicable to a merchandise display stand wherein the distal end 15 of the upright 14 is positioned at any vertical height relative to the support surface 11 that is desired for displaying the item of merchandise 30 on the display stand 10. While an arcuate shape is often preferred for both aesthetic and functional reasons, the upright 14 may also define a linear shape that is angled relative to the base 12.

A variety of components may be disposed within the base 12, including but not limited to, electronic circuitry 13 for monitoring one or more displacement sensors and for detecting the condition or state of each sensor, such as a "secured state" and an "unsecured state," and an alarm 15 that is activated by the electronic circuitry in response to a displacement sensor changing from the secured state to the unsecured state. The base 12 may also house a battery for powering the electronic circuitry 13 and/or providing primary or back-up power to the merchandise 30. A port 16 may be provided on an external surface of the base 12 for arming (i.e. turning on and off) the monitoring and detecting electronic circuitry 13. As shown in FIG. 1, the port 16 is an optical port, such as infrared (IR) port comprising an optical receiver that is operably coupled to the electronic circuitry 13. An indicator 18, such as a light-emitting-diode (LED) may also be provided on an external surface of the base 12 for indicating the status of the display stand 10, for example, whether the display stand is powered; whether the electronic circuitry 13 is armed or disarmed; and/or whether the alarm 15 is activated. If desired, a displacement sensor 19 (FIGS. 2A-2C) may be disposed within the base 12 and electrically connected to the monitoring and detecting electronic circuitry 13 for determining whether the bottom surface of the base of the display stand 10 is in contact, or in close proximity to, the support surface 11. Accordingly, the displacement sensor 19 identifies a possible theft if the base 12 of the display stand 10 is separated from the support surface 11 and operates to cause the electronic circuitry 13 to activate the alarm 15. Typically, an adhesive layer, such as pressure sensitive tape, is disposed between the base 12 and the support surface 11 to temporarily secure the display stand 10 to the support surface. Alternatively, the base 12 may be secured to the support surface 11 by one or more mechanical fasteners.

As shown herein, the base 12 and the upright 14 of the display stand 10 house an elongate, flexible and extensible security cable 24. The security cable 24 is attached in a suitable manner at a first (i.e. lower) end to the base 12 and at a second (i.e. upper) end to sensor housing 20. In particular, the lower end of the security cable 24 terminates within the base 12 of the display stand 10 and the upper end of the security cable terminates within the sensor housing 20. Alternatively, the security cable 24 may pass through the support surface 11 and terminate at a dedicated or central (i.e. common) power and/or alarm unit in what is well known and oftentimes referred to in the art as a "line alarm system." The security cable 24 may have any construction, but preferably is a coiled helical cable, such as a conventional telephone cord, having a relaxed length and an extended length in a known manner. Typically, the extended length of the security cable 24 is at least about twice its relaxed length. In this manner, a potential purchaser may remove the merchandise 30 from the display stand 10 up to a distance equal to the extended length of the security cable 24 to a comfortable and convenient location for examining and/or operating the merchandise. The security cable 24 automatically retracts back to its relaxed length within the upright 14 and the base 12 of the display stand 10 as the potential purchaser returns the merchandise 30 to the display stand. Although a coiled helical cable is shown and described herein, the security cable 24 may also be a conventional linear cable that is extracted from and retracted into the display stand 10 by a powered or biased (e.g. spring-tensioned) recoiler or retracting mechanism.

The security cable 24 may provide only a mechanical connection between the base 12 and the sensor housing 20, or as shown and described herein, may provide both a mechanical and an electrical or optical connection between the base and the sensor housing. Consequently, the security cable 24 may comprise one or more conductors for operably connecting a displacement sensor 22 disposed within the sensor housing 20 with the monitoring and detecting electronic circuitry 13 disposed within the base 12 of the display stand 10. As is well known, the displacement sensor 22 is operable for determining whether the merchandise 30 is in contact with, or in close proximity to, the top surface of the sensor housing 20. Accordingly, the displacement sensor 22 functions to identify a possible theft if the merchandise 20 is separated from the sensor housing 20 and to cause the electronic circuitry 13 to activate the alarm 15. Typically, an adhesive layer, such as pressure sensitive tape, is disposed between the sensor housing 20 and the merchandise 30 to temporarily secure the merchandise to the sensor housing. Alternatively, the merchandise 30 may be secured to the sensor housing 20 by one or more mechanical fasteners. In addition, the security cable 24 may provide primary or back-up power to the merchandise 30 in any known and suitable manner.

Regardless, the security cable 24 transitions along an exit path (also referred to as an "exit line") that is defined by the geometry of the upright 14 of the display stand 10. In particular, the upright 14 is generally hollow and defines an internal passageway 25 for guiding the security cable 24 between the relaxed length and the extended length. Preferably, the geometry of the internal passageway 25 provides a smooth transition for the security cable 24 between the relaxed length and the extended length. For example, the interface between the base 12 and the upright 14 is preferably contoured such that the security cable 24 passes easily and without obstruction between the base 12 and the upright 14. Likewise, the distal end 15 of the upright 14 is contoured such that the security cable 24 passes easily and without obstruction out of and back into the upright 14. Preferably, the upright 14 is annular and generally circular or elliptical such that the upright forms a tube having a smooth inner wall for guiding the security cable 24 within the internal passageway 25. It should be noted that the sensor housing 20 preferably comprises a post 21 opposite the top surface adhered to the merchandise 30 that is configured complimentary to the geometry of the internal passageway 25 at the distal end 15 of the upright 14. In this manner, the post 21 of the sensor housing 20 is disposed at least partially within the internal passageway 25 to assist in positioning the sensor housing and the merchandise 30 on the display stand 10.

Figure 2A:
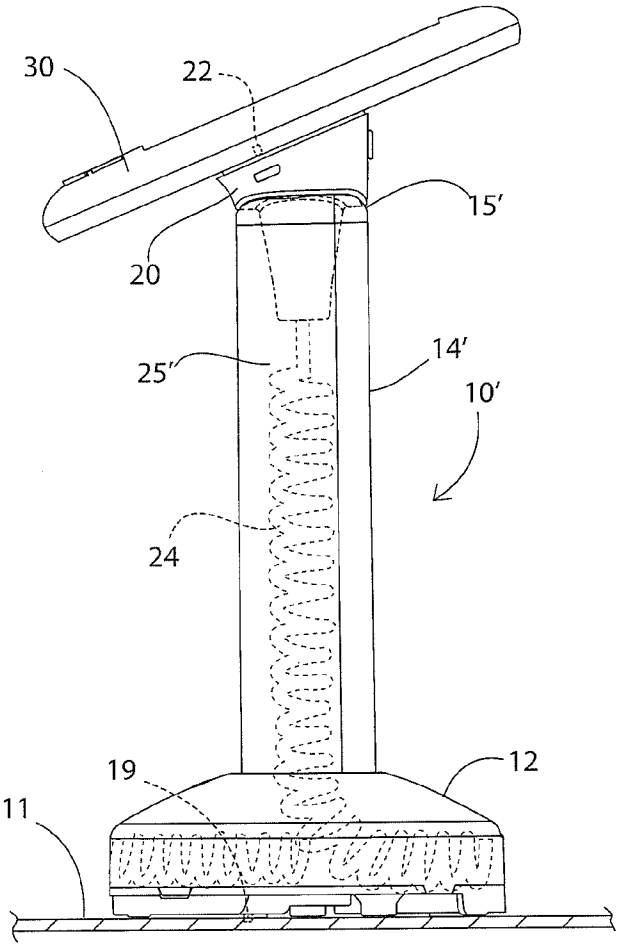
Fig. 2A (Prior Art)
FIG. 2A is an elevation view of a conventional merchandise display stand showing an item of merchandise in a display position on the display stand with a security cable attached to the item of merchandise.
Figure 2B:
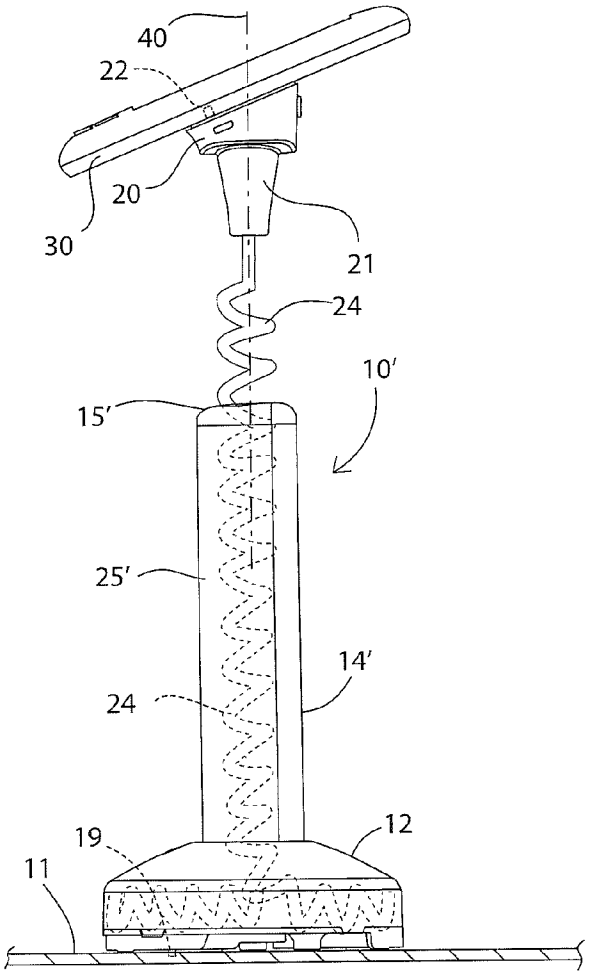
Fig. 2B (Prior Art)
FIG. 2B is an elevation view of the conventional merchandise display stand of FIG. 2A showing the item of merchandise and the security cable lifted upward from the display stand in a vertical direction.
Figure 2C:
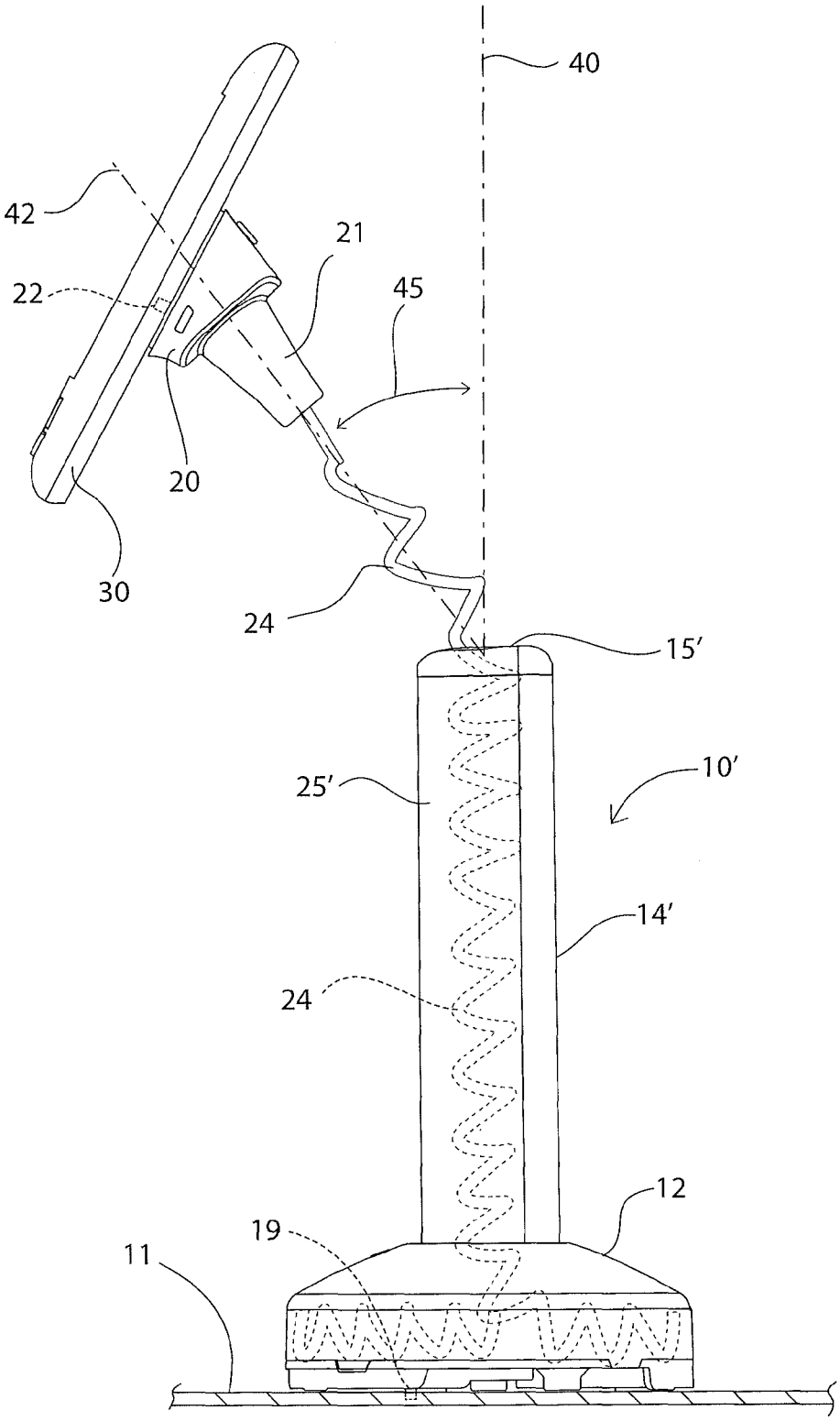
Fig. 2C (Prior Art)
FIG. 2C is an elevation view of the conventional merchandise display stand of FIG. 2A showing the item of merchandise and the security cable in a desired position for a potential purchaser to more closely examine and/or operate the item of merchandise.

FIGS. 2A-2C illustrate a prior art display stand 10' comprising an upright 14' having a generally linear shape and that is generally perpendicular to the base 12 of the display stand. As shown in FIG. 2A, the security cable 24 is disposed within the upright 14' in a generally vertical orientation relative to the support surface 11 with the merchandise 30 positioned on the display stand 10' in a display position. As such, the security cable 24 is at its relaxed length and is fully retracted within the base 12 and the upright 14' of the display stand 10'. As shown in FIG. 2B, the upright 14', and more particularly the internal passageway 25', defines a generally linear initial exit path for the security cable 24 that is parallel to a central axis 40 of the display stand 10' as the merchandise 30 is lifted upward in a vertical direction. Typically, a potential purchaser lifts the merchandise 30 (along with the sensor housing 20 adhered to the merchandise) upward in a generally vertical direction to remove the merchandise from the display stand 10'. As shown in FIG. 2C, the merchandise 30 is then pulled in a generally horizontal direction to a desired position for the potential purchaser to more closely examine and/or operate the merchandise. As such, an upper length of the security cable 24 defines a subsequent exit path 42 for the security cable 24 that is disposed at an angle indicated by reference character 45 relative to the central axis 40 of the display stand 10'. The potential purchaser may attempt to simultaneously lift and pull the merchandise 30 along the subsequent exit path 42 to the desired position. However, the distal end 15' of the upright 14' of the display stand 10' provides an increased resistance against extension of the security cable 24 from the upright 14' of the display stand 10'. This is particularly problematic when the security cable 24 is in the form of a coiled helical cable because the coils of the cable have a tendency to "hang up" or "snag" on the distal end 15' of the upright 14'. As a result of the increased resistance, repeated cycling of the security cable 24 between its relaxed length and its extended length will cause extensive wear, and ultimately failure, of the security cable.

Figure 3A:
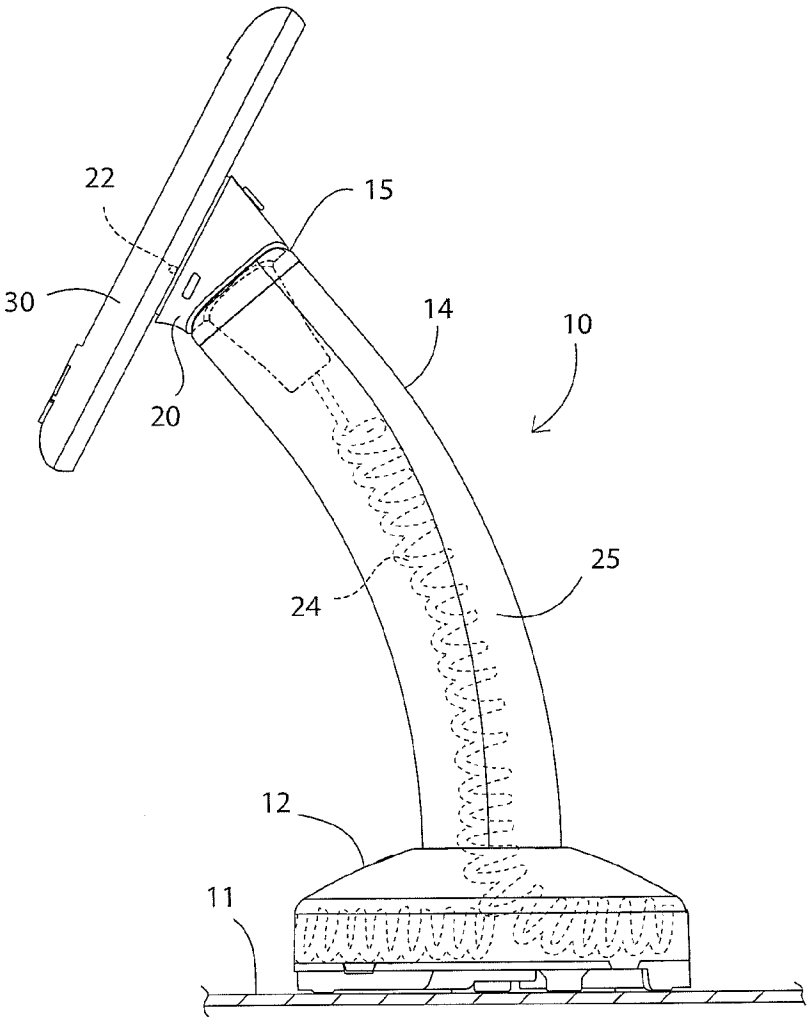
FIG. 3A is an elevation view of a merchandise display stand defining an angled exit path in accordance with the invention showing an item of merchandise in a display position on the display stand.
Figure 3B:
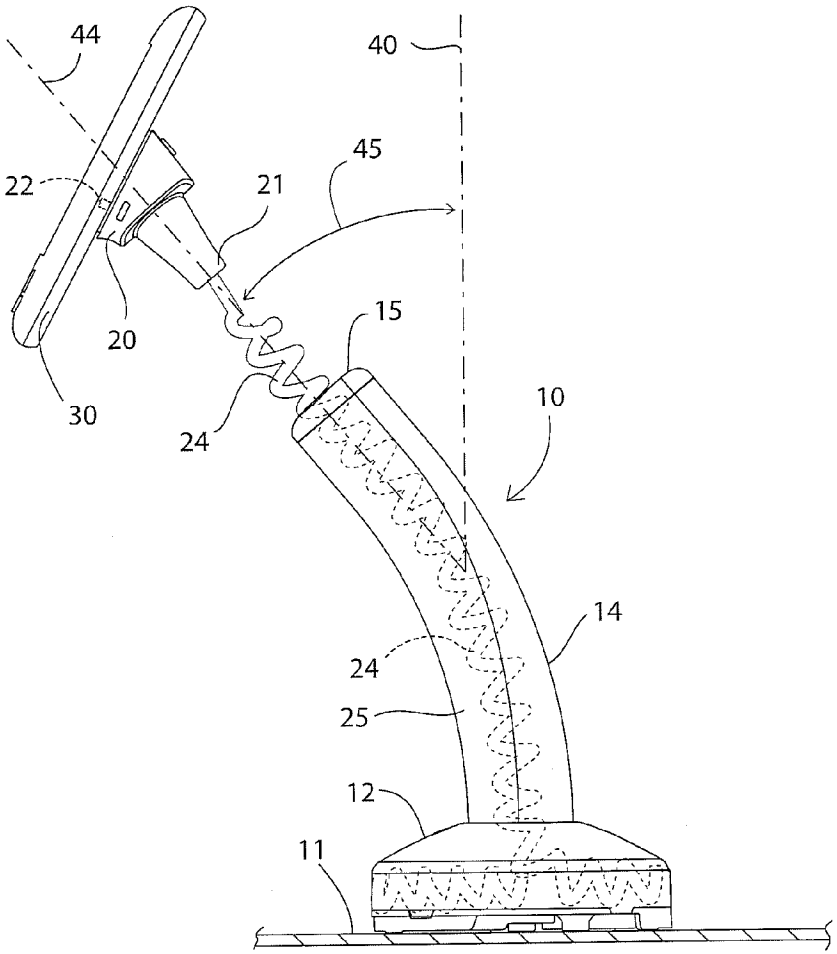
FIG. 3B is an elevation view of the merchandise display stand of FIG. 3A showing the item of merchandise and the security cable in a desired position for a potential purchaser to more closely examine and/or operate the item of merchandise.

FIGS. 3A and 3B illustrate a display stand 10 that defines an angled exit path 44 according to the present invention. As shown in FIG. 3A, the security cable 24 is positioned within the upright 14 in a generally arcuate orientation relative to the support surface 11 with the merchandise 30 positioned on the display stand 10 in a display position. As such, the security cable 24 is at its relaxed length and is fully retracted within the base 12 and the upright 14 of the display stand 10. As shown in FIG. 3B, the upright 14, and more particularly the internal passageway 25, defines a generally arcuate transition for the security cable 24 that is disposed at an angle indicated by reference character 45 relative to the central axis 40 of the display stand 10 as the merchandise 30 is lifted away from the display stand 10. As a result of the upright 14 of the display stand 10 being arcuate or angled, a potential purchaser will simultaneously lift and pull the merchandise 30 (along with the sensor housing 20 adhered to the merchandise) upwardly and outwardly to remove the merchandise from the display stand 10. As such, the upper length of the security cable 24 defines an angled exit path 44 for the security cable 24 that is disposed at the angle 45 relative to the central axis 40 of the display stand 10. Preferably, the angle 45 defined by the central axis 40 and the angled exit path 44 is an acute angle between about fifteen and about seventy-five degrees. Furthermore, the distal end 15 of the upright 14 of the display stand 10 provides little or no resistance against extension of the security cable 24 from the upright 14 of the display stand 10. Accordingly, a security cable 24 in the form of a coiled helical cable does not have a tendency to "hang up" or "snag" on the distal end 15 of the upright 14. As a result, a display stand 10 defining an angled exit path according to the present invention permits a potential purchaser to more easily move the merchandise 30 to the desired position to closely examine and/or operate the merchandise without causing extensive wear, and possibly failure, of the security cable 24 due to repeated cycling of the security cable between its relaxed length and its extended length.

The foregoing has described one or more exemplary embodiments of a merchandise display stand for displaying an item of merchandise. The merchandise display stand defines an angled exit path for a security cable attached to the merchandise. More particularly, an upright of the display stand is arcuate or angled such that the merchandise may be removed from the display stand with little or no resistance against extension of the security cable from the upright of the display stand and without causing extensive wear of the security cable. Preferred embodiments of the merchandise display stand have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A display stand for displaying an item of merchandise on a support surface, comprising:

a base;

an upright extending from the base and defining an internal passageway, the upright being generally arcuate relative to the support surface; and a security cable extending from the base through the internal passageway of the upright to the item of merchandise;

wherein the upright defines an angled exit path for the security cable.

2. A display stand according to claim 1, wherein the upright is generally angled relative to the support surface.

3. A display stand according to claim 1, having a central axis that is generally perpendicular to the support surface and wherein the central axis forms an acute angle with the angled exit path.

4. A display stand according to claim 3, wherein the acute angle is between about fifteen and about seventy-five degrees.

5. A display stand according to claim 1, wherein the security cable is an elongate, flexible and extensible coiled helical cable.

6. A display stand according to claim 5, wherein the coiled helical cable has a relaxed length and an extended length that is at least twice the relaxed length.

7. A display stand according to claim 1, wherein the base houses electronic circuitry for monitoring and detecting an unsecured state of at least one sensor.

8. A display stand according to claim 7, wherein the base further houses a first displacement sensor for indicating whether the base is separated from the support surface.

9. A display stand according to claim 8, wherein the base further houses an alarm that is activated by the electronic circuitry when the first displacement sensor indicates that the base is separated from the support surface.

10. A display stand according to claim 7, further comprising a sensor housing disposed between the security cable and the item and wherein the sensor housing has a second displacement sensor for indicating whether the item is separated from the sensor housing.

11. A display stand according to claim 10, wherein the base further houses an alarm that is activated by the electronic circuitry when the second displacement sensor indicates that the item is separated from the sensor housing.

12. A display stand for displaying an item of merchandise, comprising:

a base configured for attachment to a support surface;

an upright extending upwardly from the base and defining an internal passageway, the upright being generally arcuate relative to the support surface;

a security cable extending from the base to a sensor housing configured for attachment to the item of merchandise;

wherein the internal passageway of the upright defines an angled exit path for the security cable to remove the sensor housing and the item of merchandise from the display stand.

13. A merchandise display stand according to claim 12, wherein the angled exit path forms an acute angle with a central axis of the display stand that is between about fifteen and about seventy-five degrees.

14. A merchandise display stand according to claim 12, further comprising:

a first displacement sensor having a secured state and an unsecured state for indicating that the base is separated from the support surface;

a second displacement sensor having a secured state and an unsecured state for indicating that the merchandise is separated from the sensor housing;

electronic circuitry for monitoring and detecting the unsecured state of the first displacement sensor and the unsecured state of the second displacement sensor and for activating an alarm when the first displacement sensor or the second displacement sensor is in the unsecured state.

* * * * *